US010561211B2

(12) United States Patent
Leitermann

(10) Patent No.: US 10,561,211 B2
(45) Date of Patent: Feb. 18, 2020

(54) PROTECTIVE COVER

(71) Applicant: Marc Leitermann, Rosbach vor der Hoehe (DE)

(72) Inventor: Marc Leitermann, Rosbach vor der Hoehe (DE)

( * ) Notice: Subject to any disclaimer, the term of this patent is extended or adjusted under 35 U.S.C. 154(b) by 0 days.

(21) Appl. No.: 16/076,715

(22) PCT Filed: Feb. 8, 2017

(86) PCT No.: PCT/EP2017/052699
§ 371 (c)(1),
(2) Date: Aug. 9, 2018

(87) PCT Pub. No.: WO2017/137414
PCT Pub. Date: Aug. 17, 2017

(65) Prior Publication Data
US 2019/0045896 A1 Feb. 14, 2019

(30) Foreign Application Priority Data
Feb. 10, 2016 (DE) ..... 10 2016 201 968

(51) Int. Cl.
*A45C 7/00* (2006.01)
*B65B 11/00* (2006.01)
(Continued)

(52) U.S. Cl.
CPC ..... *A45C 7/0054* (2013.01); *A45C 7/0095* (2013.01); *A45C 11/24* (2013.01);
(Continued)

(58) Field of Classification Search
CPC . B65B 11/004; A45C 7/0054; A45C 13/1069; A45C 15/06; A45C 11/20;
(Continued)

(56) References Cited

U.S. PATENT DOCUMENTS 4,984,906 A * 1/1991 Little ..... A45C 9/00 190/107
6,223,400 B1 5/2001 Lenack
(Continued)

FOREIGN PATENT DOCUMENTS

CN 201358043 Y 12/2009
DE 202006016582 U1 1/2007
(Continued)

OTHER PUBLICATIONS

English translation of International Preliminary Report on Patentability in International Application No. PCT/EP2017/052699, dated Aug. 23, 2018.
(Continued)

*Primary Examiner* — Christopher R Demeree
(74) *Attorney, Agent, or Firm* — J.A. Lindeman & Co. PLLC; Jeffrey Lindeman; Aaron Raphael

(57) ABSTRACT

The invention relates to a protective cover (10) with a base, two side walls (20), a front wall, a rear wall and a lid, wherein the protective cover (10) comprises a blank (12) which is formed integrally and is composed of a plastics material. The blank (12) has a base region (24'), a rear wall region (18'), a front wall region (16'), two side wall regions (20') and a lid region (22'), and the blank (12) is folded in a cuboidal shape. Furthermore, it is provided that the protective cover (10) has connecting elements (14) with magnetic elements and optionally counter elements, wherein the connecting elements (14) are designed and arranged in such a manner that the edges of the blank (12) that butt against one another in the folded cuboidal shape are held together by the connecting elements (14) which exert magnetic attraction forces on one another.
Furthermore, the invention relates to a folding sheet (11) which can be folded to form such a protective cover (10).

14 Claims, 6 Drawing Sheets

(51) Int. Cl.

| | |
|---|---|
| ***A45C 13/10*** | (2006.01) |
| ***A45C 15/06*** | (2006.01) |
| ***A45C 11/24*** | (2006.01) |
| ***B42D 3/04*** | (2006.01) |
| ***B65D 5/00*** | (2006.01) |
| ***B42D 3/02*** | (2006.01) |
| ***B42D 3/10*** | (2006.01) |
| ***B42D 3/12*** | (2006.01) |
| ***B65D 5/20*** | (2006.01) |
| ***B65D 5/32*** | (2006.01) |

(52) U.S. Cl.

CPC ..... *A45C 13/1069* (2013.01); *A45C 15/06* (2013.01); *B42D 3/02* (2013.01); *B42D 3/045* (2013.01); *B42D 3/10* (2013.01); *B42D 3/123* (2013.01); *B65B 11/004* (2013.01); *B65D 5/00* (2013.01); *B65D 5/2066* (2013.01); *B65D 5/321* (2013.01); *B42P 2241/20* (2013.01); *B65D 2203/12* (2013.01); *B65D 2313/04* (2013.01)

(58) Field of Classification Search

CPC ..... A45C 2007/0004; A45C 13/002; B65D 2313/02; B65D 1/225; B65D 2313/00

USPC ..... 229/100; 190/107, 1, 114; 383/4; 150/154, 901; 206/287.1; 220/4.08, 7

See application file for complete search history.

(56) References Cited

U.S. PATENT DOCUMENTS

| | | | | |
|---|---|---|---|---|
| 7,044,277 | B2 * | 5/2006 | Redzisz | A45C 7/0077 190/107 |
| 7,278,539 | B2 * | 10/2007 | Souza | A45C 3/00 190/107 |
| 7,377,692 | B1 * | 5/2008 | Troncoso | A45C 11/20 150/154 |
| 7,861,857 | B2 * | 1/2011 | Vorderkunz | A45C 13/03 190/115 |
| 8,225,934 | B1 | 7/2012 | Malcolm et al. | |
| 10,064,466 | B2 * | 9/2018 | Fulton | A45C 7/0077 |
| 2003/0221924 | A1 * | 12/2003 | Tong | A45C 7/0036 190/107 |
| 2008/0099542 | A1 | 5/2008 | Bondarik | |
| 2009/0090709 | A1 | 4/2009 | Shalomoff | |
| 2010/0089786 | A1 | 4/2010 | Chang et al. | |
| 2010/0133141 | A1 * | 6/2010 | Lebel | A45C 9/00 206/545 |
| 2010/0181311 | A1 | 7/2010 | Costecalde | |
| 2010/0317499 | A1 | 12/2010 | Tao | |
| 2011/0192891 | A1 | 8/2011 | Farris | |
| 2015/0251824 | A1 | 9/2015 | Orthmann | |

FOREIGN PATENT DOCUMENTS

| | | | |
|---|---|---|---|
| DE | 102008036935 | A1 | 2/2010 |
| EP | 2628405 | A1 | 8/2013 |
| JP | S5830936 | A | 2/1983 |
| JP | 3129352 | U | 2/2007 |
| JP | 3188197 | U | 1/2014 |
| JP | 2014114031 | A | 6/2014 |
| KR | 20100107204 | A | 10/2010 |
| WO | 2009/031784 | A1 | 3/2009 |
| WO | 2011117208 | A1 | 9/2011 |
| WO | 2011119066 | A1 | 9/2011 |

OTHER PUBLICATIONS

English Translation of International Search Report and Written Opinion in International Application No. PCT/EP2017/052699, dated May 2, 2017.

English Machine Translation of DE 102008036935 A1, dated Feb. 11, 2010.

* cited by examiner

PROTECTIVE COVER

The invention relates to a protective cover and to a folding sheet which can be folded to form the protective cover.

Collectors' objects, such as, for example, video games, CDs, DVDs, Blu-Ray disks, books, figures and the like are customarily accommodated in an associated packaging. For collectors, these objects are generally of particular value whenever not only the object itself, but also the packaging thereof is in a satisfactory state. Various protective covers, with which items, in particular collectors' objects, can be protected against environmental influences, are known in the prior art. The protective covers then generally lie here tightly against the item to be protected such that the latter cannot move freely within the cover.

DE 10 2008 036 935 A1 discloses a protective cover for books, which can be produced from a foldable material in sheet form. The sheet is folded for this purpose, wherein adhesive strips fix the sheet in the folded shape. In one embodiment, the protective cover is of cuboidal configuration, wherein one side of the protective cover is open such that a book can be pushed into and removed again from the protective cover.

A particular disadvantage of the known protective covers is that the item to be protected has to be pushed into the protective cover. In the process, friction occurs between the wall of the protective cover and the item to be protected, as a result of which the latter may be damaged. In particular, the action of pushing the item in and taking it out again may cause scratches to appear on said item, which reduce the value of the item as a collector's object.

It is therefore an object of the invention to provide a protective cover which completely surrounds an object to be protected such that the latter is protected against environmental influences, wherein the disadvantages of the prior art are avoided.

DISCLOSURE OF THE INVENTION

A protective cover with a base, two side walls, a front wall, a rear wall and a lid is proposed, wherein the protective cover comprises a blank which is formed integrally and is composed of a plastics material. The blank has a base region, a rear wall region, a front wall region, two side wall regions and a lid region, and the blank is folded in a cuboidal shape. Furthermore, it is provided that the protective cover has connecting elements, preferably with magnet elements and optionally counter elements, wherein the connecting elements are designed and arranged in such a manner that all of the edges of the blank that butt against one another in the folded cuboidal shape are held together preferably solely by the connecting elements which preferably exert magnetic attraction forces on one another.

The connecting elements are preferably connected fixedly to the blank. A first portion of the connecting elements ends flush here with the outer borders of the blank and a second portion of the connecting elements projects beyond the outer borders of the blank, wherein a connecting element ending flush in each case interacts with a connecting element projecting beyond the outer border. "Connected fixedly" is understood here as meaning that the connecting element cannot be separated from the blank without being destroyed.

Alternatively, the connecting elements are not connected fixedly to the blank, wherein in each case two connecting elements interact on opposite sides of the surface of the blank. "Not connected fixedly" is understood here as meaning that the connecting elements are placed onto the blank and are held on the blank only by magnetic attraction forces of two connecting elements.

The protective cover is preferably held in the cuboidal shape only via the magnetic forces of the connecting elements. Further connections between parts of the blank, whether provided in the form of a force fit by non-magnetic connecting means, form fit or integrally bonded fit, are preferably not used. No plug-in connectors, plug-in tabs or the like are therefore arranged on the blank, and, for folding the blank into the cuboidal shape, the edges of the blank that butt against one another in the cuboidal shape are not adhesively bonded or welded. The magnetic connections can always be released again easily, and also the protective cover can be easily completely opened and thereby set into a flat state. A flat state means here that, after release of the magnetic connections, the blank, optionally after smoothing down or pressing, assumes a substantially level shape.

The proposed protective cover is held in the cuboidal shape in particular by magnetic forces of the connecting elements, and therefore the protective cover can easily be unfolded. In order to accommodate an item in the protective cover, the latter is preferably first of all completely opened, i.e. unfolded, such that the blank is substantially level. The item to be protected which preferably has a cuboidal shape is then deposited on the blank, for example on the base region, and then the protective cover is folded up again using the connecting elements around the item to be protected to form the cuboidal protective cover. Alternatively, a region of the preferably completely unfolded protective cover is placed against the item to be protected and then the protective cover is folded up using the connecting elements around the item to be protected to form the cuboidal protective cover.

The item to be protected advantageously does not have to be pushed here along any wall of the protective cover. The item is merely deposited on the blank of the protective cover and then parts of the blank are placed against the item by folding parts or regions of the blank. A relative movement between a surface of the item to be protected and a surface of the protective cover does not take place here.

When original packagings are an item which is to be protected, the problem may occur that the original packaging may have a slight convex deformation because of its age and/or content. In order to protect items of this type, a flexible but nevertheless stable protective cover is therefore required. The materials used and the fundamental design make it possible to be able to adapt the protective cover to a small extent to the convex shapes without the stability or function of the protective cover being impaired. The items which are accommodated in the protective cover are therefore protected in a manner laying as close as possible against the latter without pressure being exerted on the contents.

The connecting elements are preferably configured and arranged in such a manner that substantially all of the edges of the cuboid, at which edges of the folded blank butt against one another, are covered by the connecting elements. By this means, it is avoided that gaps through which dust may penetrate are exposed in the protective cover. Substantially here means that on account of manufacturing tolerances and in order to avoid overlapping of connecting elements, small portions of the edges of the cuboid, in particular at the ends of the edges or at the corners of the cuboid, may have breaks or gaps which are not covered by a connecting element. Said remaining exposed gaps preferably have a length of less than 1 mm here.

The blank is preferably manufactured from a plastics material. The plastics material is present here as a flat, planar material and the blank is obtained from the plastics material, for example by punching or cutting. The plastics material is, for example, a transparent plastics film or a plastic sheet with a thickness within the range of 10 μm to 600 μm, preferably within the range of 100 to 400 μm and particularly preferably within the range of 200 to 300 μm. The plastics material can also consist of a plurality of layers which are connected in a planar manner to one another, for example by adhesive bonding, welding, sewing or laminating.

The delimitations between the individual regions of the blank, i.e. the delimitations between base region, lid region, front region, rear wall region and the side wall regions, constitute folding lines at which the blank is folded to produce the cuboidal shape. Said folding lines are preferably prepared for the folding. This can take place, for example, by the blank being pre-folded or bent at the folding lines such that a fold is already formed along the folding line. Furthermore, it is possible to weaken the plastics material along the folding lines by means of a notch or perforation, and therefore the plastics material can be more easily folded along the folding line. In particular in the case of a plastics material of high thickness, it can also be provided to form film hinges along the folding lines.

The plastics material is preferably selected from a polyester, such as, for example, polyethyleneterephthalate (PET), polyvinylchloride (PVC), polypropylene (PP), polyethylene (PE), polycarbonate (PC), styrene copolymers, such as Styrolux®, or from mixtures of various polymers.

It is preferred here if at least portions of the plastics material are obtained from renewable resources. One example thereof is bio-PET.

The blank is preferably transparent at least in partial regions. For example, at least the front wall of the protective cover or the front wall region of the blank is of transparent design such that the item which is accommodated in the protective cover is visible and can be presented together with the protective cover. Preferably, the entire blank is transparent.

The shape of the blank is selected, for example, in such a manner that the rear wall region and the front wall region are adjacent to the base region, the lid region is adjacent to the front region, and that the two side regions are adjacent to the base region. If the individual regions are correspondingly folded, a cuboidal shape arises here. Other arrangements of the respective regions are also possible here. In particular, the rear wall region and the front wall region can be adjacent here to the base region and the two side wall regions can be adjacent to the front wall region or to the rear wall region.

The shape of the respective regions of the blank is selected here to be rectangular in each case, and therefore the folded-up blank has a cuboidal shape. The geometrical dimensions of the respective regions of the blank are selected in such a manner that the arising cuboid can surround the object to be protected. The internal dimensions of the cuboid or of the protective cover preferably correspond here to the external dimensions of the object to be protected, and therefore a relative movement of the object within the protective cover, during which scratches may arise, is avoided.

The items to be protected are preferably collectors' objects, such as, for example, video games, CDs, DVDs, Blu-Ray disks, books, figures and the like in their associated packaging. The respective packaging here is in particular a sought-after collector's object if said packaging is in a satisfactory state. The dimensions of the protective cover and therefore the dimensions of the respective regions of the blank are preferably predetermined by the dimensions of the typical collectors' objects and in particular by the typical packaging for video games, CDs, DVDs, Blu-Ray disks and the like.

The dimensions of the cuboidal protective cover are preferably within the range of 20 to 300 mm in length, within the range of 20 to 300 mm in width and within the range of 5 to 300 mm in height. For example, dimensions of approx. 135 mm in length, 190 mm in width and 15 mm in height arise for a protective cover for accommodating typical DVD packaging for the cuboid.

The connecting elements preferably comprise magnetic elements and optionally counter elements. At least one connecting element is preferably of foldable design and is arranged in the protective cover preferably folded in an L shape, U shape, frame shape or as a combination of a plurality of said shapes.

Such a foldable magnetic element or counter element is obtained from a planar material by punching or cutting, wherein folding lines can be prepared as in the case of the blank.

An "L" shape is produced, for example, by folding a rectangular foldable connecting element by approx. 90° along a folding line which runs parallel to one of the edges. A "U" shape is produced, for example, by folding a rectangular foldable connecting element along two folding lines which both run parallel to each other and to one of the edges of the connecting element. The two foldings are designed here in such a manner that the "U" shape arises. A frame shape arises, for example, by folding a rectangular foldable connecting element, wherein a magnetic element is preferred. The connecting element here has four folding lines which are each parallel to one of the edges of the rectangle. This gives rise to five regions which are each separated from one another by the folding lines. At least four of said regions are of identical size here, the fifth region can be of smaller design. A folding by approx. 90° is formed at each folding line, wherein, after the folding, the fifth region partially overlaps the first region, such that a closed frame arises. If a magnetic element is arranged in the frame shape, the frame is kept in shape by the magnetic attraction between the first region and the fifth region. Foldable and non-foldable connecting elements can also be used in combined form in the protective cover. All of the connecting elements are preferably of foldable design.

The magnetic elements are preferably designed in the form of permanent magnets. Permanent magnets, for example composed of a hard magnetic material, such as alloys of iron, cobalt, nickel or rare earth magnets, are obtainable in various shapes. The magnetic elements are particularly preferably designed in the form of permanently magnetic films or bands. In contrast to, for example, rod- or disk-shaped permanent magnets, these films and/or bands are flexible and foldable.

A magnetic element interacts with one or more further connecting elements in the protective cover. The further connecting elements can likewise be designed here in the form of permanent magnets, wherein the poles of the magnets are oriented in such a manner that they attract one another in the closed or folded-up protective cover. Furthermore, the further connecting elements can be designed as counter elements, or a magnetic element can interact with a combination of further magnetic elements and counter elements.

The counter elements are not designed to be permanently magnetic, wherein the counter elements are attracted by a magnet. The counter elements are preferably designed in the form of a metal sheet or in the form of a metal foil, which are attracted by the respective magnetic elements.

In one embodiment of the invention, the connecting elements are not connected fixedly to the blank. In order to close the protective cover, a respective connecting element on each side of the surface of the blank therefore interacts in the region of an edge of the blank. Some of the connecting elements, preferably magnetic elements, are placed directly here onto the item to be protected or are applied to the latter. Further connecting elements are placed from the outside onto the blank or are applied to the latter after the blank is folded into the cuboidal shape. In this case, two connecting elements interact on opposite sides of the blank.

In a further embodiment of the invention, the connecting elements are connected fixedly to the blank, for example by adhesive bonding, welding, sewing or laminating. The connecting elements can be arranged here on one of the two surfaces of the blank, or connecting elements can be adhesively bonded or laminated between two plastics layers of the blank. The connecting elements are preferably arranged here on the outer borders of the blank that, in the folded-up state, butt against one another as edges of the cuboid. Some of the connecting elements can end flush here with the outer borders of the blank while other connecting elements can project beyond the outer borders of the blank. In the folded-up state, a connecting element ending flush preferably in each case interacts here with a connecting element projecting beyond the outer border.

At least some of the connecting elements are designed to be foldable and/or the blank has tabs which are adjacent to the respective regions and on which connecting elements are arranged. By folding of the connecting elements and/or the tabs, two connecting elements are in each case placed onto each other when the blank is folded up to form the cuboidal shape, wherein said connecting elements are held together by the magnetic forces and thereby fix the blank in the cuboidal shape.

If connecting elements are designed to be foldable and projecting over the surface of the blank, they can be folded in the manner of tabs. In this case, the blank preferably does not have any tabs. If the blank has tabs adjacent to the respective regions, all of the connecting elements can be arranged on the blank such that none of the connecting elements projects beyond the surface of the blank.

The fixed arrangement of the connecting elements on the blank has the advantage that the entire protective cover consists of only one cohesive piece. The connecting elements are already arranged correctly with respect to one another and with respect to the blank here, which considerably simplifies the closing of the protective cover.

A magnetic element with which the protective cover can be fastened to a metal plate or a magnetic board is preferably arranged on a surface of the blank that points outward in the protective cover. For example, a permanent magnet is arranged for this purpose on the base or on the rear wall. Said permanent magnet does not have to be designed to be foldable, and therefore in particular even powerful rare earth magnets can be used. With the magnetic element, the protective cover together with the item accommodated therein can be fastened to a magnetic board or the like such that the item can be presented attractively.

In order to be able to present the item accommodated in the protective cover with particular emphasis, the protective cover can additionally comprise illuminating means. The latter can be designed, for example, as an LED strip, LED band, as a planar OLED or as an electroluminescent film. The protective cover can additionally comprise a battery or an accumulator for the supply of energy. In addition, a solar cell can be arranged in the protective cover for charging the accumulator.

The protective cover preferably has one or more labeling elements. The latter can be designed, for example, as a region on the blank that can be labeled or printed and permit the attaching of additional information, for example regarding the item accommodated in the protective cover.

A further aspect of the invention is to provide a folding sheet which comprises a blank composed of a plastics material and connecting elements fastened to the blank, wherein the blank is foldable to form one of the protective covers described. Accordingly, the features described within the scope of the protective cover are also considered to be disclosed for the folding sheet.

BRIEF DESCRIPTION OF THE FIGURES

Exemplary embodiments of the invention are illustrated in the drawings and explained in more detail in the description below, in which.

In the description below of exemplary embodiments of the invention, identical or similar components and elements are denoted by the same or similar reference signs, wherein a repeated description of said components or elements is omitted in individual cases. The figures are only a schematic illustration of the subject matter of the invention.

Figure 1:
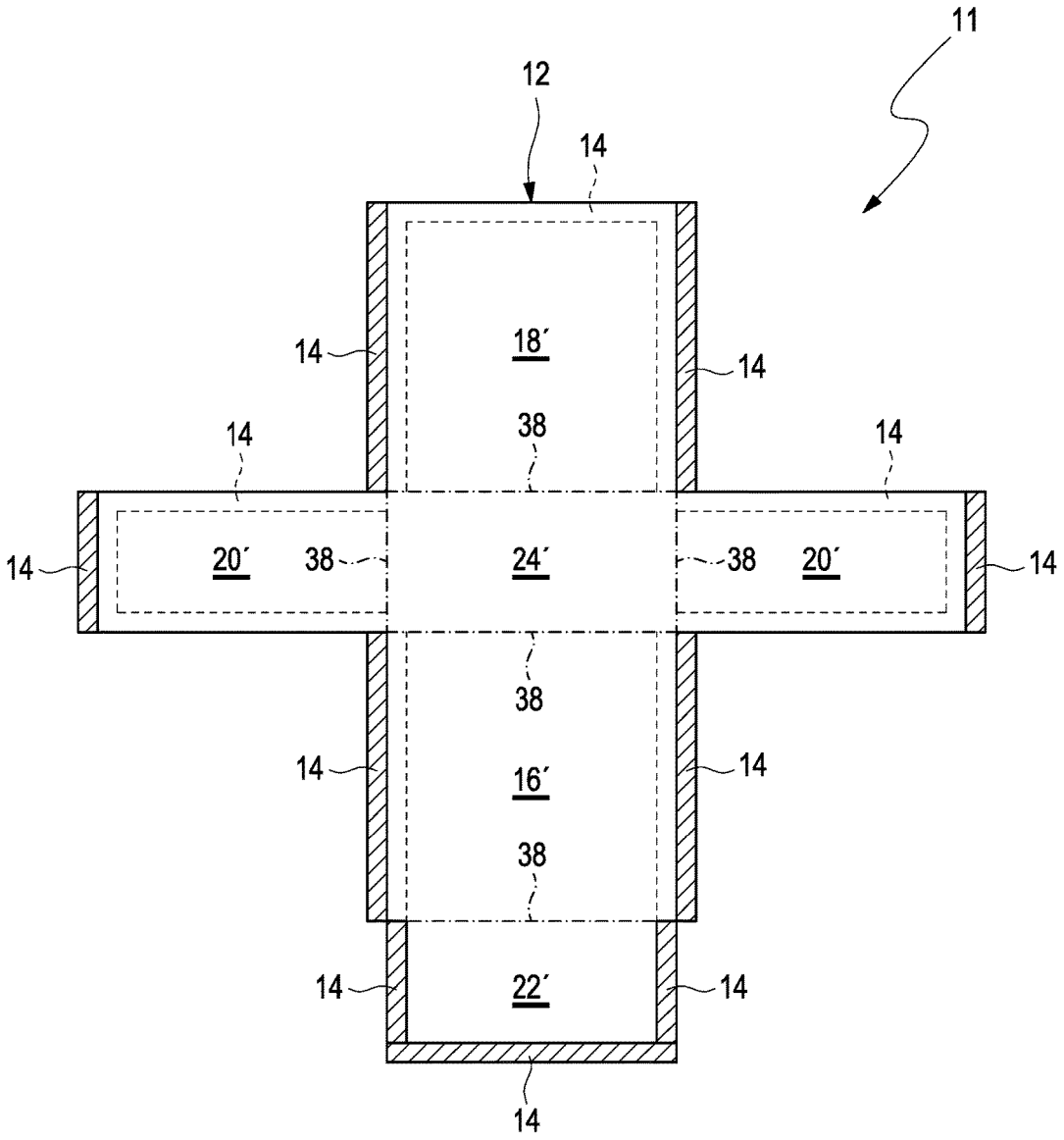
FIG. 1 shows a blank with connecting elements.

FIG. 1 shows a first variant of a blank 12 for a first embodiment of the protective cover 10. The blank 12 is formed integrally and is produced from a plastics material by trimming or punching. The blank 12 comprises a plurality of regions (16', 18', 20', 22', 24'), namely a base region 24', to which a rear wall region 18', two side walls regions 20' and a front wall region 16' are adjacent. A lid region 22' is adjacent to the front wall region 16'.

A plurality of connecting elements 14 which, in this embodiment, are all designed as a magnetic film are arranged on the blank 12. The magnetic film is connected to the blank 12 by adhesive bonding. Except for the connecting elements which are arranged on the lid region 22', all of the connecting elements 14 are adhesively bonded to the lower side of the blank 12, wherein said connecting elements each partially project beyond the blank 12. Two connecting elements 14 of the lid region 22' are adhesively bonded to the upper side of the blank 12 and do not project beyond the blank 12.

The blank 12 and the connecting elements 14 form a folding sheet 11 which can be folded to form a protective cover. The folding sheet 11 is folded here along folding lines 38. This is described below with reference to FIGS. 2*a* and 2*b*. The folding lines 38 are illustrated with chain-dotted lines in the figures. FIG. 1 illustrates the folding sheet 11 in a top view, wherein the visible surfaces of the connecting elements 14 are illustrated in shaded form and surfaces concealed by the blank 12 are indicated by dashed lines. It is easily apparent from FIG. 1 that, in the illustrated embodiment of the folding sheet 11, during the folding to form a cuboid, at the points of which two edges of the blank meet, a protruding part of a connecting element 14 in each case interacts with a non-protruding part of another connecting element 14, wherein the respectively protruding part can be folded over in the form of a tab in order to fix the edges in the cuboidal shape.

Figure 2A:
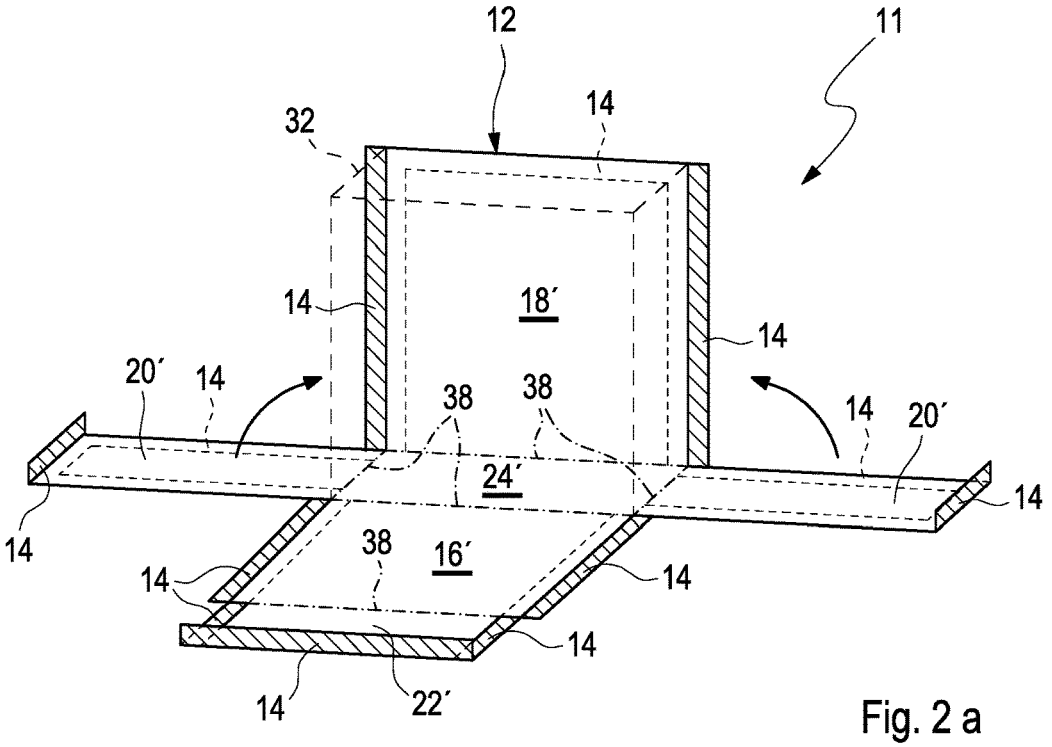
FIGS. 2*a* and 2*b* show the folding of a blank with connecting elements to form a protective cover.
Figure 2B:
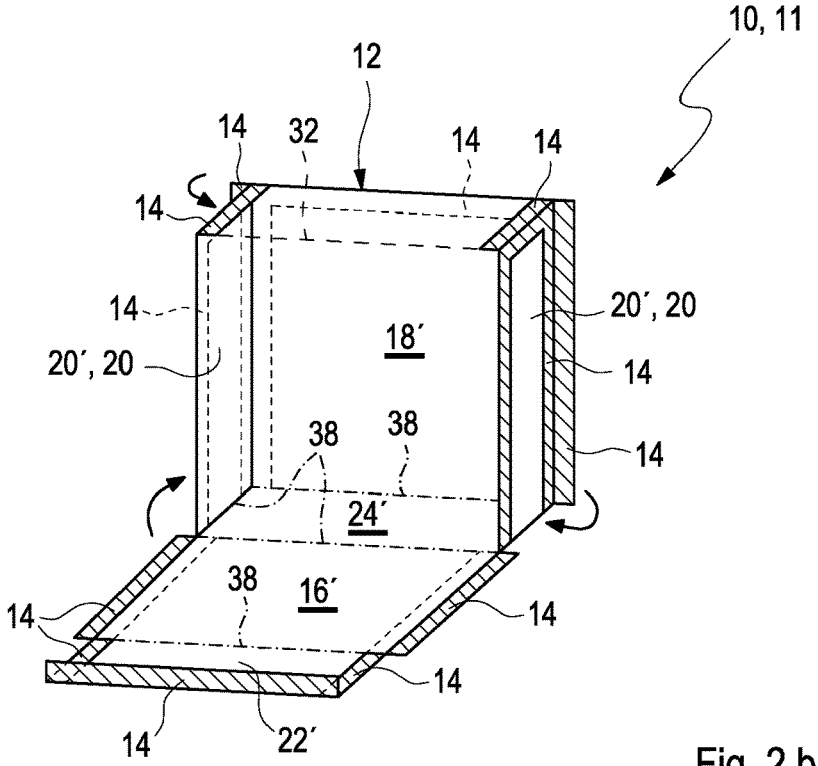

FIGS. 2*a* and 2*b* show the folding sheet 11 from FIG. 1 in a perspective illustration. In order to fold the folding sheet 11 to form a cuboidal protective cover, an item 32 which is to be protected is deposited onto the base region 24'. The item 32 is indicated in FIGS. 2*a* and 2*b* as a cuboid shown by dashed lines.

Subsequently, the rear wall region 18' is folded by 90° such that it lies against the item 32 to be protected. Some of the connecting elements 14 can likewise already be folded by 90° in the direction of the item 32.

As illustrated in FIG. 2*b*, after the folding of the rear wall region 18', the side wall regions 20' are folded in the direction of the item 32 such that they likewise lie against the item 32. The side wall regions 20' which form the side walls 20 of the protective cover 10 are fixed by folding of connecting elements 14, which are arranged on the rear wall region 18', by 90°, wherein the connecting regions 14 which are involved then lie on one another because of the folding.

In further steps, not illustrated further, first of all the front wall region 16' and subsequently the lid region 22' are folded in each case by 90° in the direction of the item 32. By way of corresponding folding of the respective connecting elements 14 in each case by 90° in the direction of the item 32, the front wall region 16' and the lid region 22' are fixed in the cuboidal protective cover 10 produced in this manner. The item 32 which is to be protected is now completely encased by the blank 12.

Figure 3:
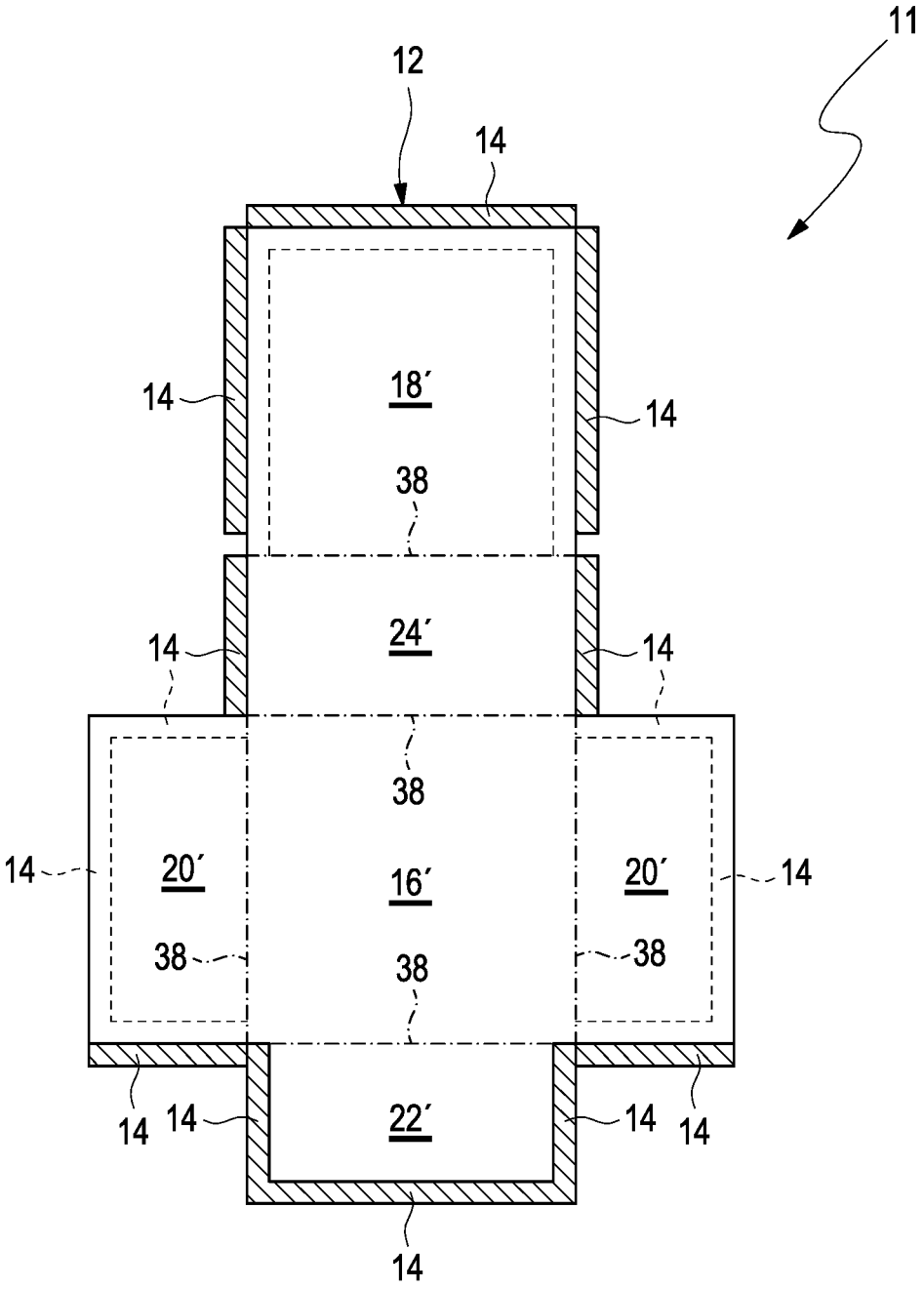
FIG. 3 shows a further variant of a blank with connecting elements.

FIG. 3 illustrates a further variant of a blank 12 which, together with connecting elements 14, forms a folding sheet 11. In contrast to the variant illustrated in FIG. 1, the two side wall regions 20' are adjacent to the front wall region 16'. In addition, the connecting elements 14 which are laterally adjacent to the rear wall region 18' do not extend over the entire length, and therefore said connecting elements do not overlap the adjacent connecting elements 14 of the base region 24' during the folding-up operation.

In order to fold a protective cover from the folding sheet 11 of FIG. 3, the procedure is analogous to that described with respect to FIGS. 2*a* and 2*b*, wherein first of all the front wall region is applied to the item 32 by folding, then the two side regions are folded by 90° toward the item 32 and the side regions are then fixed by folding of the two connecting elements 14 arranged on the base region 24'. The rear wall region 18' is subsequently folded and finally the lid region 22'.

Figure 4:
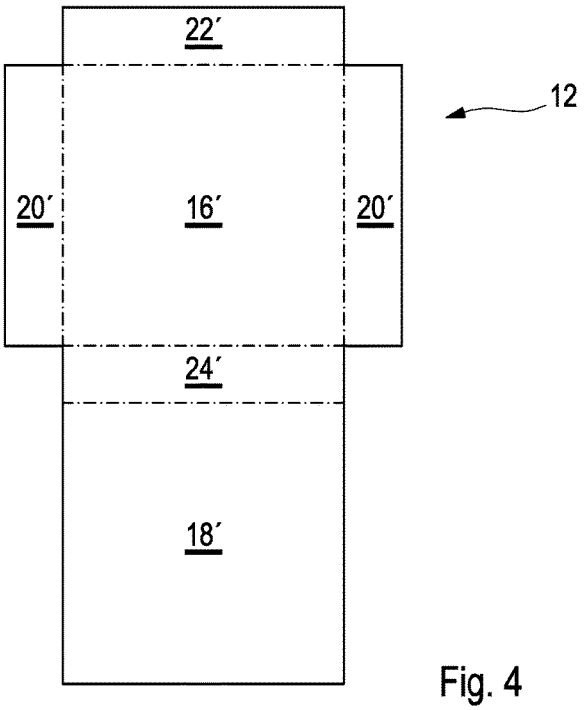
FIG. 4 shows a blank without connecting elements.

FIG. 4 shows a blank 12 without connecting elements connected thereto. The blank 12 has a front wall region 16' to which two side wall regions 20', a base region 24' and a lid region 22' are adjacent. A rear wall region 18' is adjacent to the base region 24'.

Figure 5A:
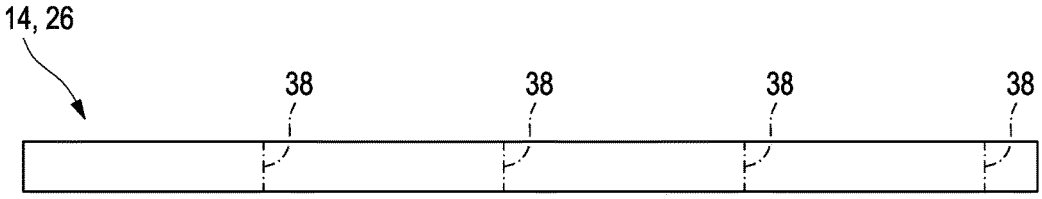
FIGS. 5*a*, 5*b*, 5*c* show foldable connecting elements.
Figure 5B:
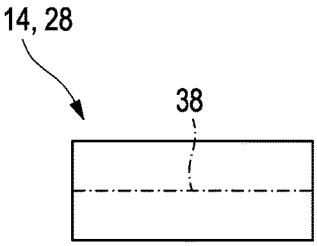
Figure 5C:
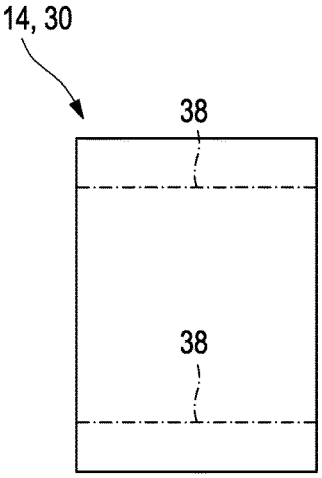

FIGS. 5*a*, 5*b* and 5*c* show foldable connecting elements 14 which are not connected to a blank 12.

FIG. 5*a* illustrates a blank 26 which is foldable to form a frame. The blank 26 which is foldable to form the frame has 4 folding lines 38 which divide said blank into five regions, of which four are identical in size.

FIG. 5*b* shows a blank 28 which is foldable in an "L" shape. Said blank can be folded by 90° along a folding line 38 such that the "L" shape arises.

FIG. 5*c* shows a blank 30 which is foldable in a "U" shape and has two mutually parallel folding lines 38. Said folding lines 38 each define a region of the "U" shape which arises when said regions are folded on one another by 90°.

Figure 6:
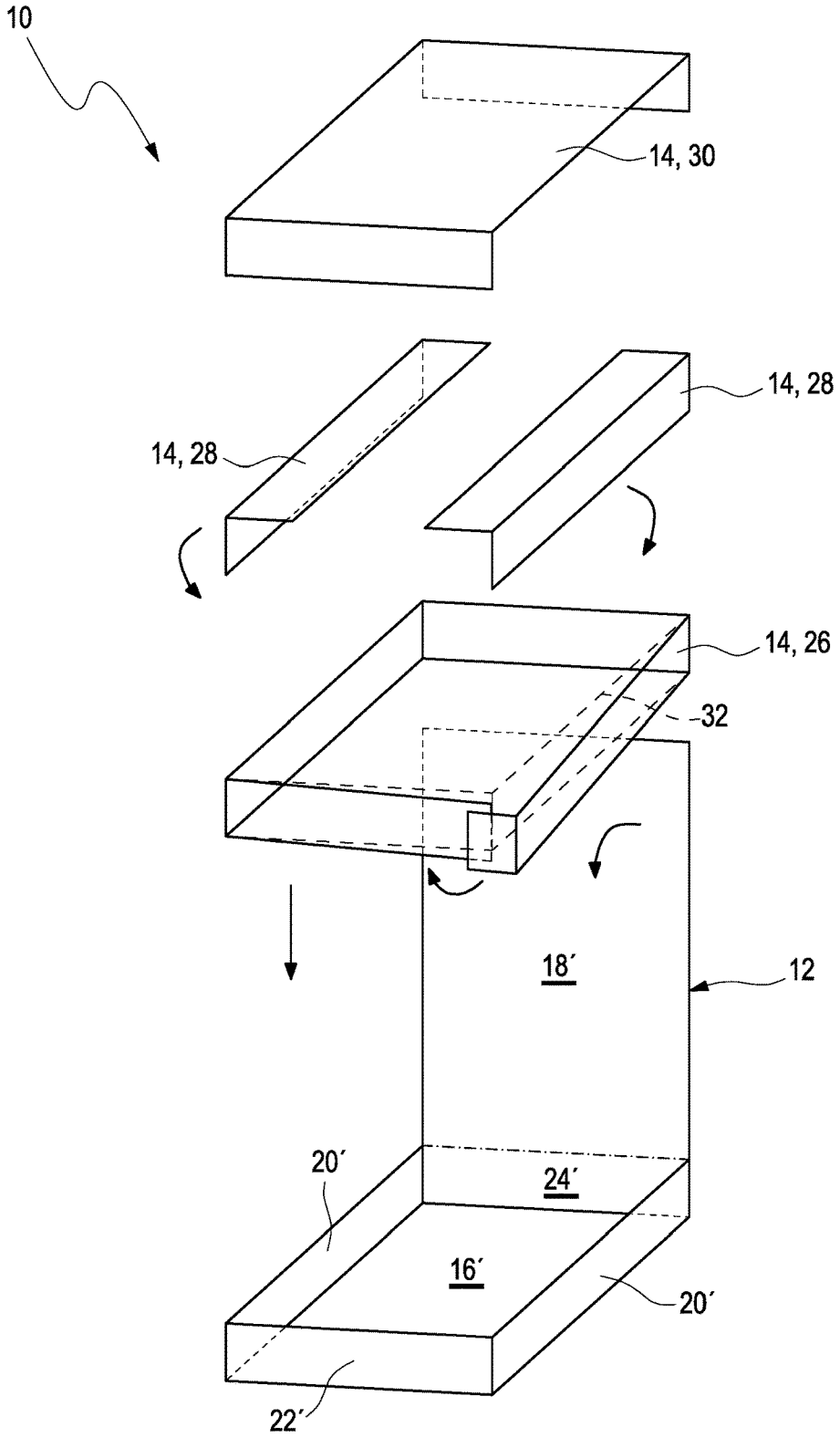
FIG. 6 shows an exploded illustration of a further embodiment of the protective cover.

FIG. 6 shows the closing of a second embodiment of the protective cover 10 which is folded from a blank 12 without fixedly connected connecting elements 14.

First of all, a connecting element 26 which is foldable to form a frame and is designed as a magnetic element is placed around the side surfaces of the item 32 to be protected and, in the process, is folded to form a frame which substantially covers the side surfaces of the item 32. The item 32 is deposited together with the frame onto the front wall region 16' of a blank 12, and the lid region 22', the side wall regions 20' and the base region are applied to the item 32 by folding. Subsequently, the rear wall region 18' can also be applied to the item 32 by folding. Respective "L"-shaped connecting elements 28, which are designed as magnetic elements, are placed on the edge of the cuboid which has been produced from the blank and at which the side wall regions 20' butt against the rear wall region 18'. Said connecting elements interact with the frame-shaped connecting element 26 and fix the blank 12 at these points in the cuboidal shape. Finally, a "U"-shaped connecting element 30, which is likewise designed as a magnetic element, is placed on, wherein the two limbs of the "U" substantially cover the lid region 22' and the base region and likewise interact here with the frame-shaped connecting element 26. The protective cover 10 is then closed and is fixed in the cuboidal shape by the magnetic forces of the connecting elements 14. In addition, the gaps in the regions of the cuboid at which two surfaces of the blank 12 butt against each other are closed in a dust-proof manner by the connecting elements 14.

Figure 7:
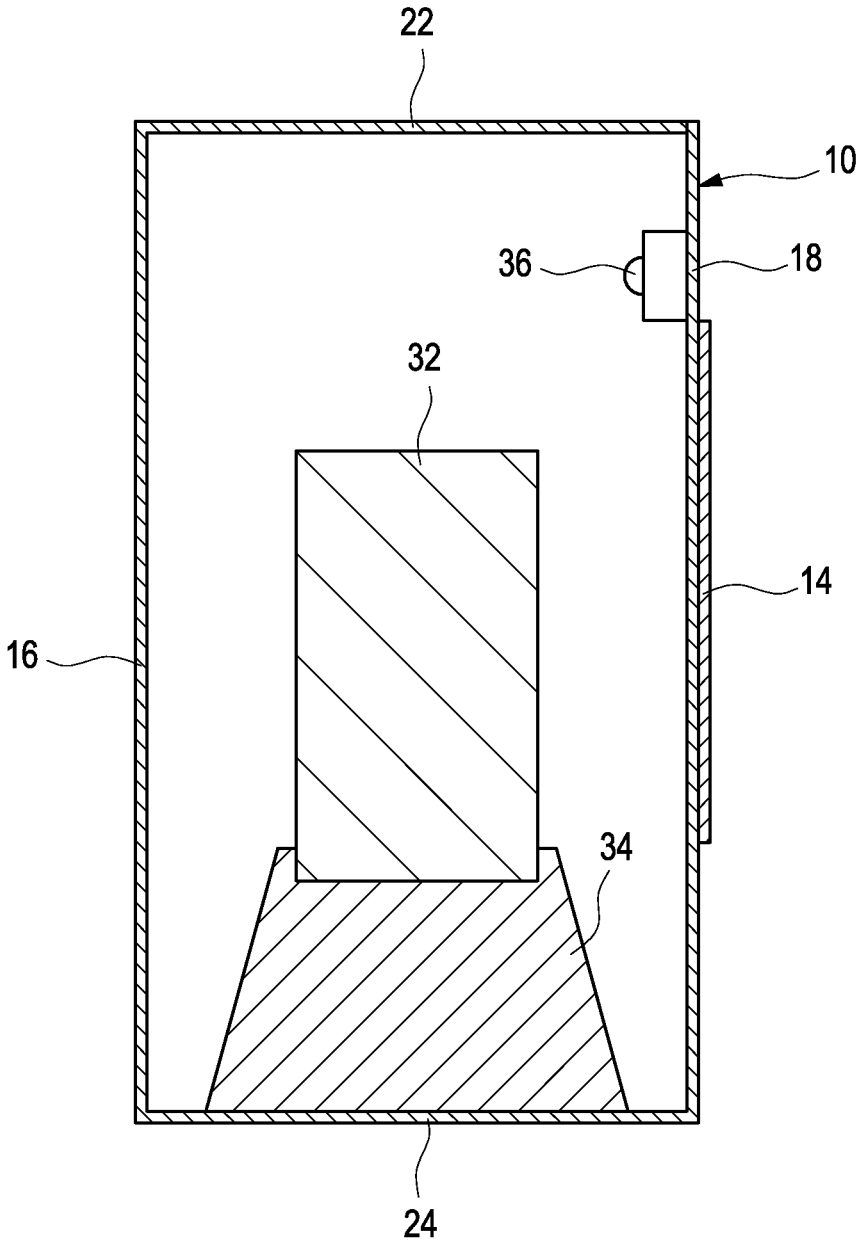
FIG. 7 shows a protective cover with illuminating means in a sectional illustration from the side.

FIG. 7 shows a protective cover 10 with an illuminating means 36, in a sectional illustration from the side. The illuminating means 36 is designed here as an LED strip and illuminates the interior of the protective cover 10 and therefore the item 32 which is accommodated in the interior of the protective cover 10. In this variant, the dimensions of the protective cover 10 are preferably selected to be larger than the item to be protected. In order to be able to present the item 32 in an esthetically attractive manner, in the variant illustrated in FIG. 7 the protective cover 10 additionally comprises a pedestal 34 on which the item 32 is accommodated. The pedestal 34 is produced, for example, from the same plastics material as the blank and can be connected to the base 24, in particular via magnetic elements.

In order to be able to fasten the protective cover 10 to a magnetic board, in the embodiment illustrated the rear wall 18 has a connecting element 14 designed as a magnetic element. Said connecting element 14 is arranged on the outer side of the protective cover 10.

The invention is not restricted to the exemplary embodiments described here and the aspects which are emphasized therein. On the contrary, a multiplicity of modifications which lie within the scope of expert action in the art are possible within the range indicated by the claims.

The invention claimed is:

1. A protective cover with a base, two side walls, a front wall, a rear wall and a lid, comprising a blank which is formed integrally and is composed of a plastics material, wherein the blank has a base region, a rear wall region, a front wall region, two side wall regions and a lid region, and the blank is folded in a cuboidal shape, wherein the protective cover has connecting elements with magnetic elements, wherein the connecting elements are designed and arranged in such a manner that the edges of the blank that butt against one another in the folded cuboidal shape are held together by the connecting elements which exert magnetic attraction forces on one another, wherein the connecting elements are connected to the blank and a first portion of the connecting elements ends flush with the outer borders of the blank and a second portion of the connecting elements projects beyond the outer borders of the blank, and wherein a connecting element ending flush in each case interacts with a connecting element projecting beyond the outer border, and at least one connecting element is designed to be foldable.

2. The protective cover of claim 1, wherein the plastics material is selected from at least one polyester, polyvinylchloride (PVC), polypropylene (PP), polyethylene (PE), polycarbonate (PC), styrene copolymers, and mixtures thereof.

3. The protective cover of claim 2, wherein the polyester is selected from the group consisting of polyethylene terephthalate (PET).

4. The protective cover of claim 1, wherein the blank is transparent at least in partial regions.

5. The protective cover of claim 1, wherein a magnetic element is arranged on the rear wall region in such a manner that the protective cover can be fastened to a magnetic wall.

6. The protective cover of claim 1, wherein the magnetic elements are designed as permanent magnets.

7. The protective cover of claim 6, wherein the permanent magnets are a permanently magnetic film and/or a permanently magnetic band.

8. The protective cover of claim 1, wherein, in the case of the blank, the rear wall region and the front wall region are adjacent to the base region, the lid region is adjacent to the front wall region or to the rear wall region, and in that the two side regions are adjacent to the base region, the front wall region or to the rear wall region.

9. The protective cover of claim 1, wherein the connecting elements are connected fixedly to the blank by means of adhesive bonding, welding, sewing, or laminating.

10. A folding sheet comprising a blank composed of a plastics material and connecting elements fastened to the blank, wherein the folding sheet is configured in such a manner that the latter is foldable to form a protective cover of claim 9, wherein the folding sheet is held together in the folded shape by magnetic attraction forces.

11. The protective cover of claim 1, furthermore comprising illuminating means for illuminating an item accommodated in the protective cover.

12. A method for producing a protective cover of claim 1, wherein an item which is to be protected is deposited on a blank and then the protective cover is folded up using connecting elements around the item to be protected to form the cuboidal protective cover, wherein the connecting elements are arranged in such a manner that the edges of the blank that butt against one another in the folded cuboidal shape are held together by the connecting elements which exert magnetic attraction forces on one another.

13. A protective cover with a base, two side walls, a front wall, a rear wall and a lid, comprising a blank which is formed integrally and is composed of a plastics material, wherein the blank has a base region, a rear wall region, a front wall region, two side wall regions and a lid region, and the blank is folded in a cuboidal shape, wherein the protective cover has connecting elements with magnetic elements, wherein the connecting elements are designed and arranged in such a manner that the edges of the blank that butt against one another in the folded cuboidal shape are held together by the connecting elements which exert magnetic attraction forces on one another, wherein the connecting elements are connected to the blank and a first portion of the connecting elements ends flush with the outer borders of the blank and a second portion of the connecting elements projects beyond the outer borders of the blank, and wherein a connecting element ending flush in each case interacts with a connecting element projecting beyond the outer border, and at least one connecting element is designed to be foldable, and wherein the connecting elements comprise counter elements and the counter elements are not designed to be permanently magnetic.

14. The protective cover of claim 13, wherein the counter elements are designed in the form of a metal sheet or a metal foil, which are attracted by the respective magnetic elements.

* * * * *